US006792982B2

(12) United States Patent
Lincoln et al.

(10) Patent No.: US 6,792,982 B2
(45) Date of Patent: Sep. 21, 2004

(54) VACUUM DEVICE FOR SUBSTANCE EXTRACTION

(75) Inventors: Danny F. Lincoln, Commerce, GA (US); Krishna Kumar, Tucker, GA (US); Mark A. Samuels, Norcross, GA (US)

(73) Assignee: Spectrx, Inc.

( * ) Notice: Subject to any disclaimer, the term of this patent is extended or adjusted under 35 U.S.C. 154(b) by 0 days.

(21) Appl. No.: 10/470,459

(22) PCT Filed: Jan. 24, 2002

(86) PCT No.: PCT/US02/02233

§ 371 (c)(1),
(2), (4) Date: Jul. 28, 2003

(87) PCT Pub. No.: WO02/058994

PCT Pub. Date: Aug. 1, 2002

(65) Prior Publication Data

US 2004/0069367 A1 Apr. 15, 2004

Related U.S. Application Data

(60) Provisional application No. 60/263,866, filed on Jan. 24, 2001.

(51) Int. Cl.[7] ..... B65B 1/04

(52) U.S. Cl. ..... 141/65; 141/98; 141/114; 141/192; 141/329

(58) Field of Search ..... 141/65, 67, 98, 141/114, 192, 195, 329, 330

(56) References Cited

U.S. PATENT DOCUMENTS 4,648,955 A 3/1987 Maget
4,928,376 A 5/1990 Poglitsch
5,149,413 A 9/1992 Maget
5,334,304 A 8/1994 Maget
5,417,822 A 5/1995 Maget
5,765,608 A 6/1998 Kristen
5,766,150 A * 6/1998 Langkau ..... 604/93.01
6,378,657 B2 4/2002 Viken

* cited by examiner

*Primary Examiner*—Timothy L. Maust
(74) *Attorney, Agent, or Firm*—Merchant & Gould

(57) ABSTRACT

A vacuum device and method for extraction of a substance from a fluid source, the vacuum device including an upper member that may be selectively, and operably, connected to a lower member. The upper member defines a bottom opening, and has a vacuum pump in fluid communication with the bottom opening. The vacuum pump is selectively coupled to an energy source. The lower member defines an inner cavity, a first opening, and a second opening, the inner cavity in communication with the first opening and the second opening. An elastic membrane defining an interior cavity is disposed in the inner cavity and is coupled to the first opening of the lower member. In use, the second opening of the lower member in placed in selective fluid communication with the fluid source, and the lower member is selectively coupled to the upper member such that the vacuum pump is electrically coupled to the energy source and the bottom opening of the upper member is in sealed contact with the first opening of the lower member so that the vacuum pump is in fluid communication with the interior cavity defined by the elastic membrane.

20 Claims, 5 Drawing Sheets

VACUUM DEVICE FOR SUBSTANCE EXTRACTION

FIELD OF THE INVENTION

The present invention relates generally to the field of substance extraction devices and, more particularly, to a vacuum device for extraction, and assessment, of a substance from a source.

SUMMARY

In accordance with the purposes of the invention, as embodied and broadly described herein, this invention, in one aspect, relates to a vacuum device and method for extraction of a substance from a source, such as a fluid source. The vacuum device includes an upper member that may be selectively, and operably, connected to a lower member. The upper member defines a bottom opening, and has a vacuum pump in fluid communication with the bottom opening. The vacuum pump is selectively coupled to an energy source. The lower member defines an inner cavity, a first opening, and a second opening, the inner cavity in communication with the first opening and the second opening. An elastic membrane defining an interior cavity is disposed in the inner cavity of the lower member and is coupled to the first opening of the lower member.

In use; the second opening of the lower member is placed in selective fluid communication with the fluid source, and the lower member is selectively coupled to the upper member such that the vacuum pump is electrically coupled to the energy source and the bottom opening of the upper member is in sealed contact with the first opening of the lower member. Thus, the vacuum pump may be placed in fluid communication with the interior cavity defined by the elastic membrane.

The membrane is movable from a first relaxed position, in which the exterior surface of the membrane is in contact with an inner surface of the inner cavity of the lower member proximate the second opening of the lower member, to a second operative position, in which portions of the membrane proximate the second opening are drawn away from the inner surface of the inner cavity and toward the first opening of the lower member so that a fluid cavity, in communication with the second opening of the lower member, is defined. The membrane moves from the first relaxed position to the second operative position upon application of vacuum to the interior cavity due to the actuation of the vacuum pump so that vacuum is applied to the second opening of the lower member.

DETAILED DESCRIPTION OF THE FIGURES

The accompanying drawings, which are incorporated in and constitute a part of this specification, illustrate several embodiments of the invention and together with the description, serve to explain the principals of the invention.

Figure 1:
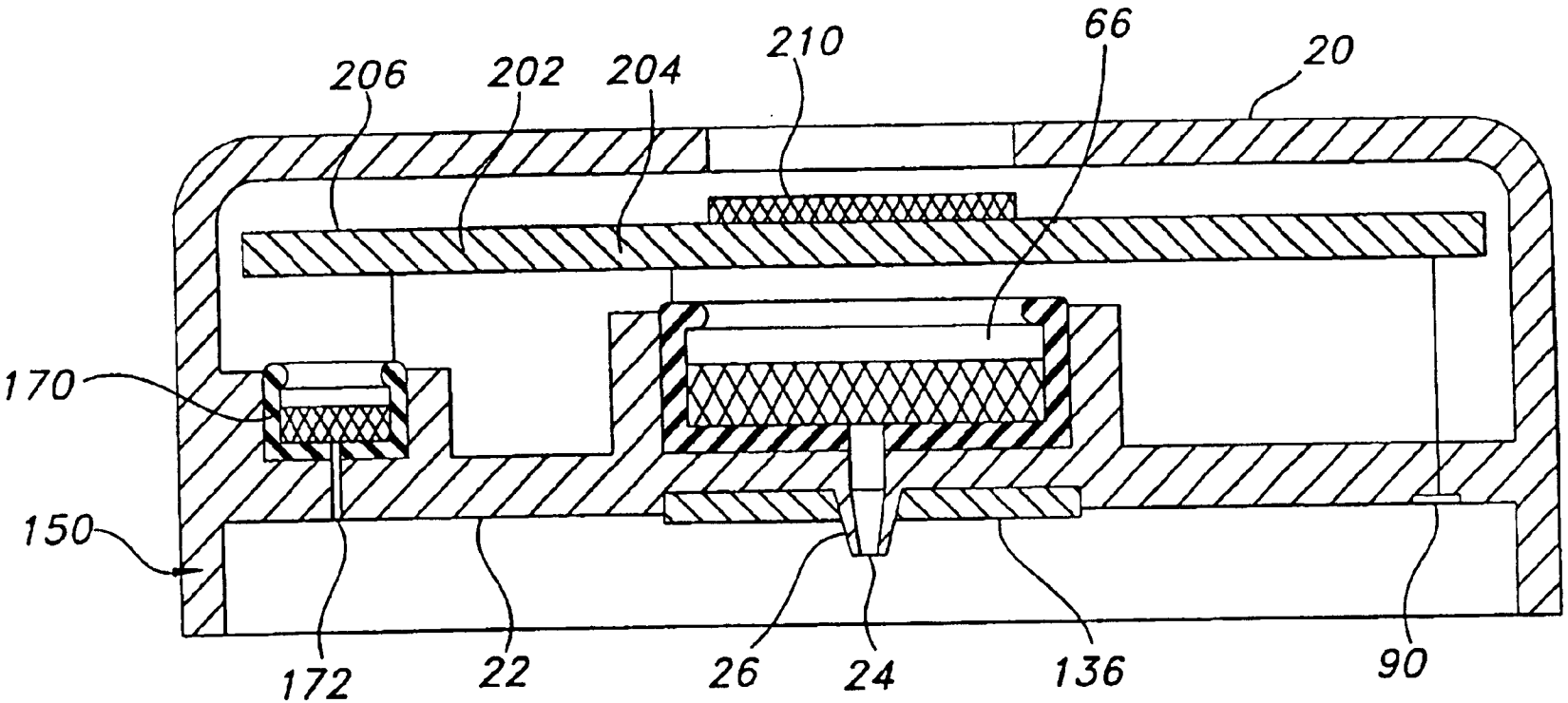
FIG. 1 is a side cross-sectional view of an exemplified structure of the upper member of the present invention.
Figure 2:
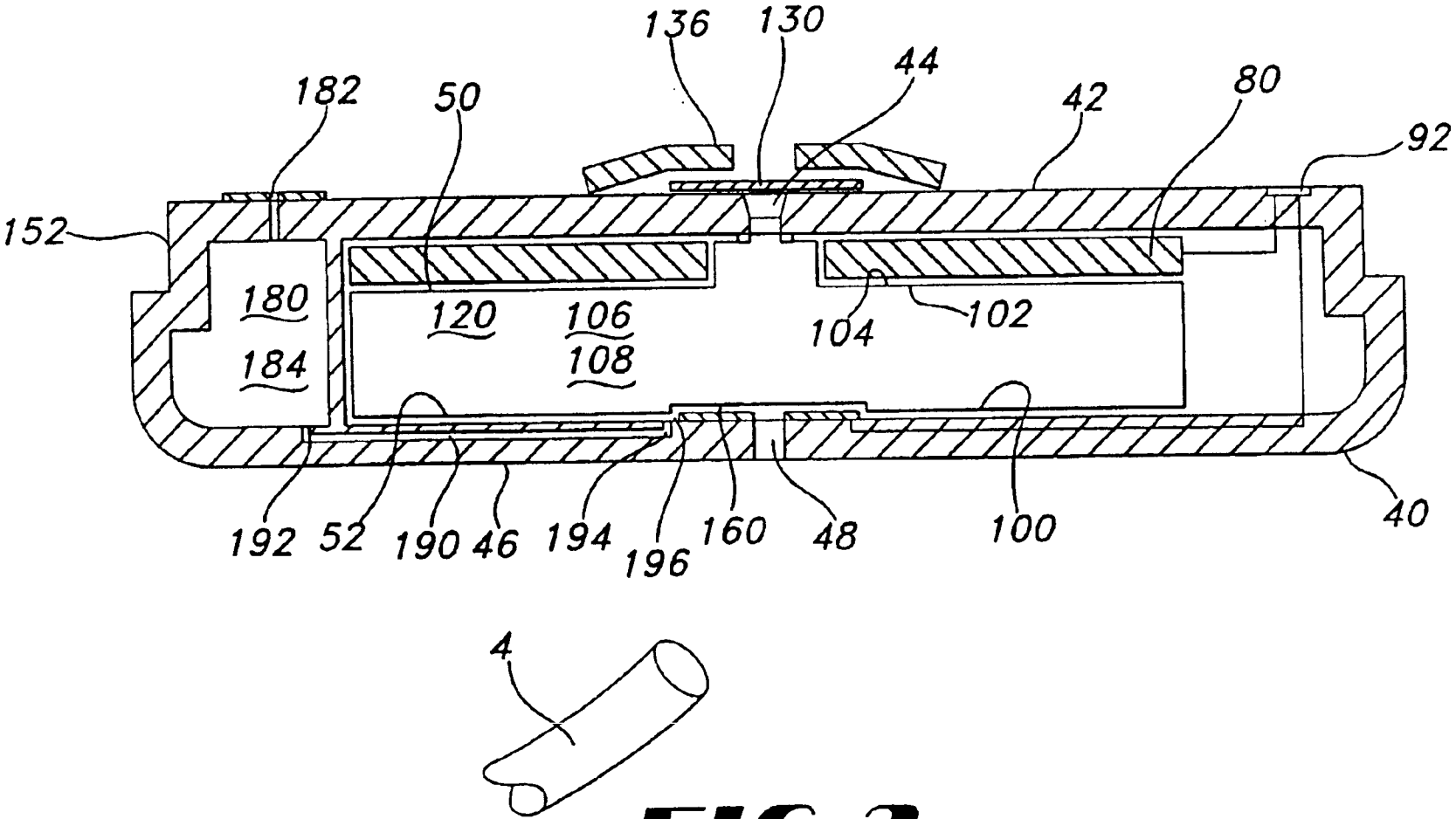
FIG. 2 is a side cross-sectional view of an exemplified structure of the lower member of the present invention showing a fluid conduit acting as a fluid source.
Figure 3:
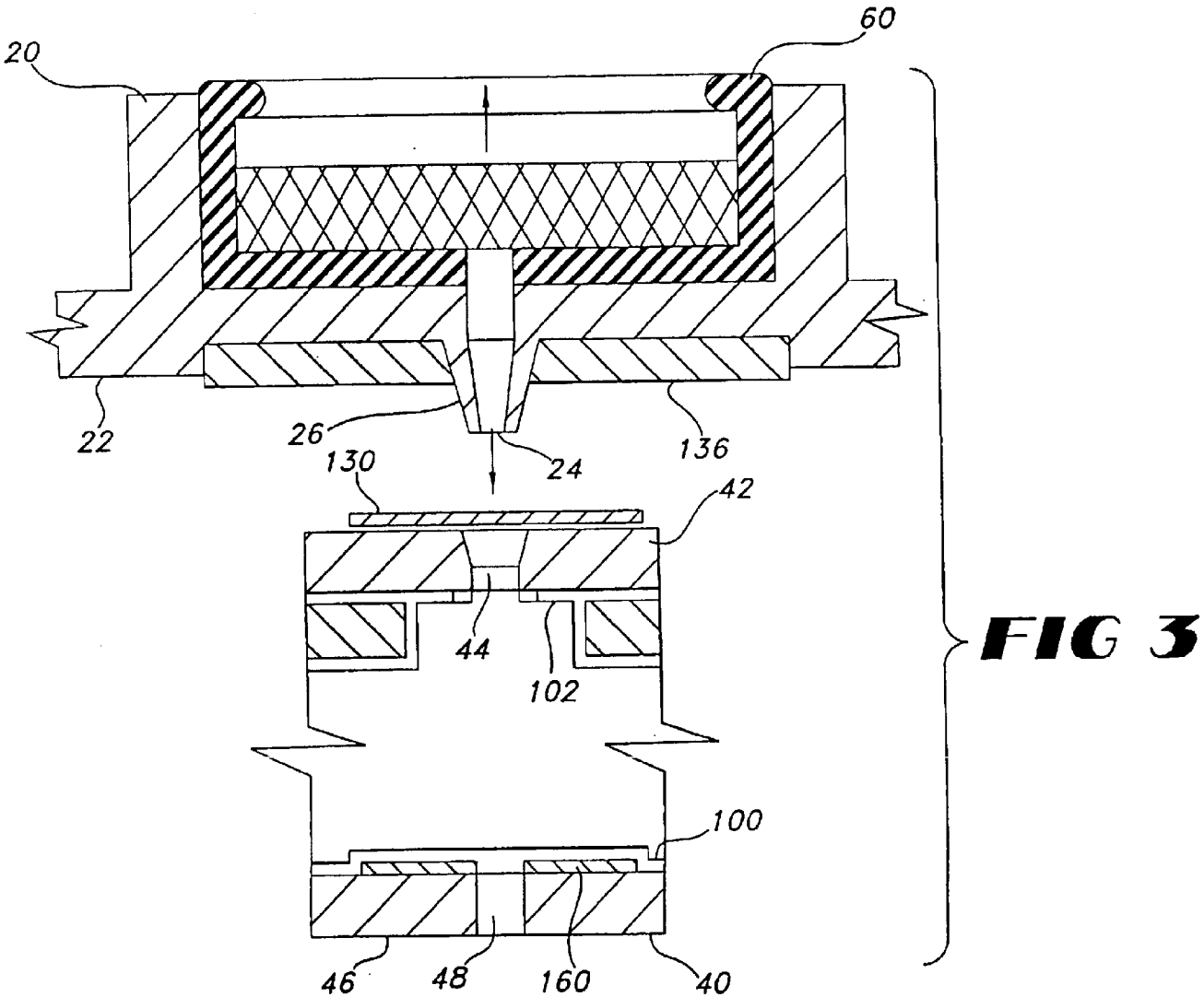

FIG. 3 is a partial side cross-sectional view of an exemplified structure of the selectable connected upper member and lower member of the present invention, the upper member showing a male port depending from a bottom surface of the upper member, the port defining a bottom opening in the upper member, the bottom opening in communication with a vacuum pump, the lower member showing a first opening and a second opening in communication with an inner cavity of the lower member.

Figure 4:
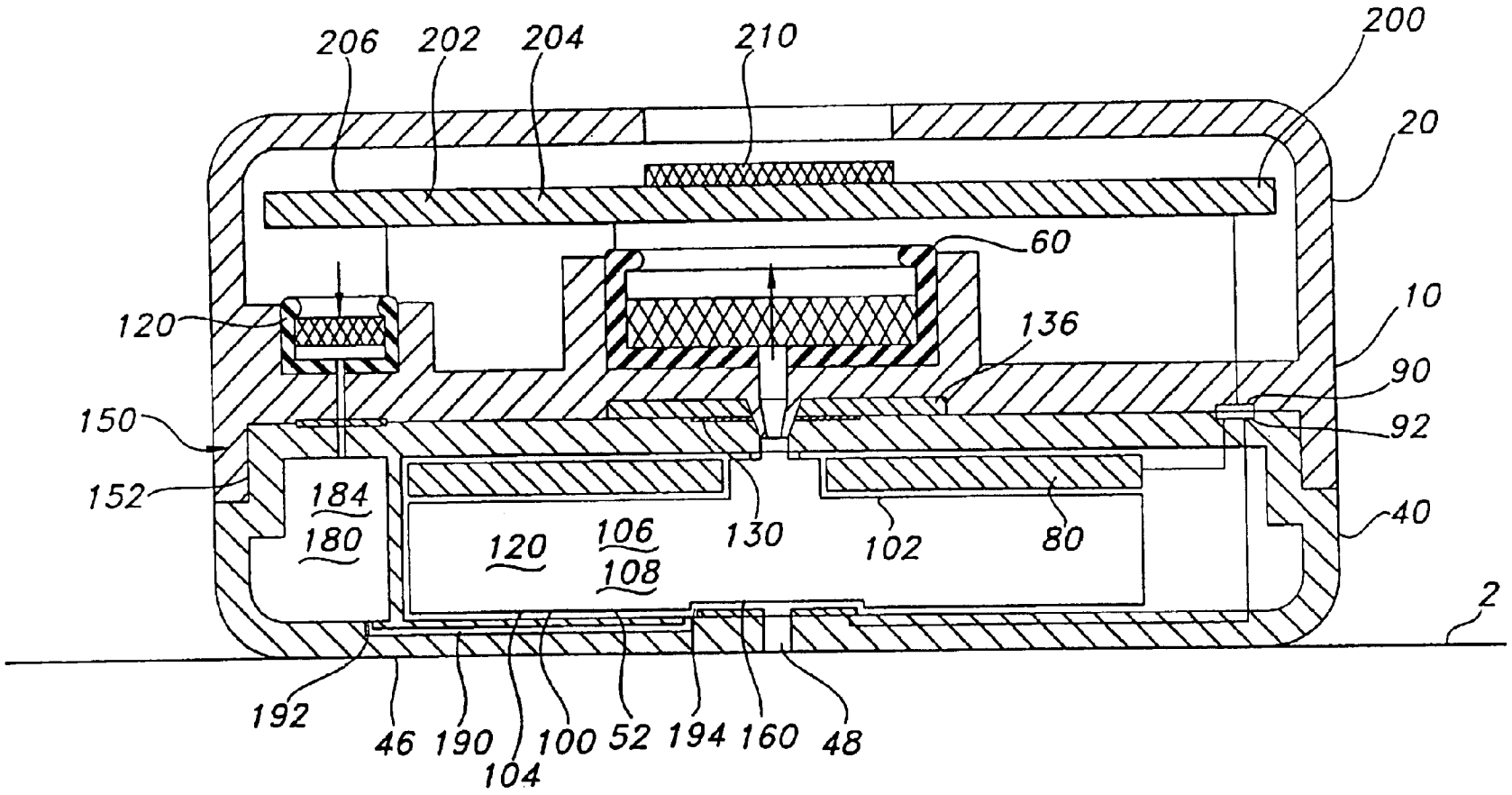

FIG. 4 is a side cross-sectional view of an exemplified structure of the present invention showing the upper member selectively connected to the lower member and a membrane, disposed therein the lower member, in a first relaxed position, in which an exterior surface of the membrane is in contact with an inner surface of the inner cavity of the lower member proximate the second opening of the lower member.

Figure 5:
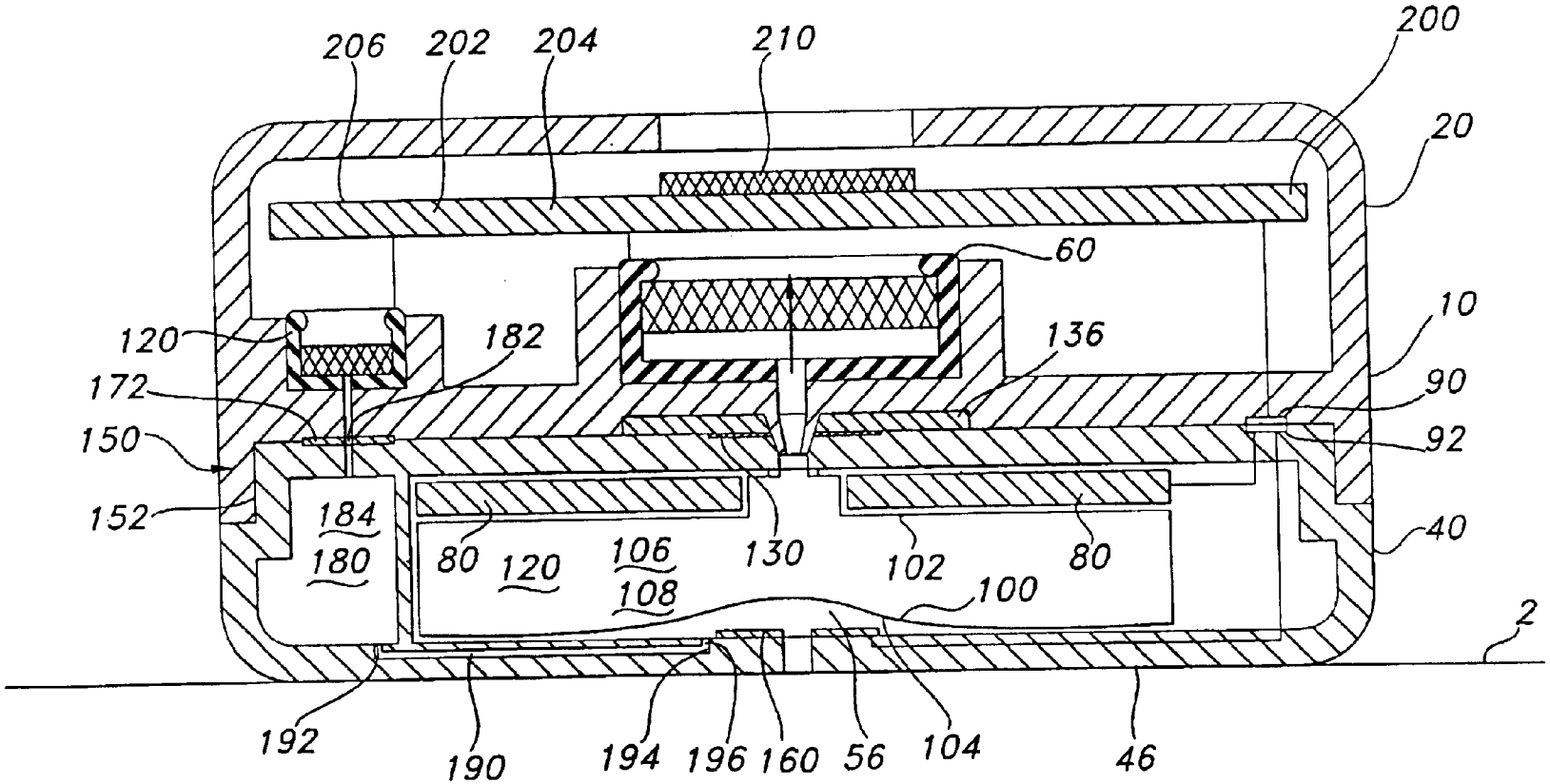

FIG. 5 is a side cross-sectional view of an exemplified structure of the present invention showing the upper member selectively connected to the lower member and a membrane, disposed therein the lower member, in a second operative position, in which portions of the membrane proximate the second opening are drawn away from the inner surface of the inner cavity and toward the first opening of the lower member so that a fluid cavity, in communication with the second opening of the lower member, is defined.

DETAILED DESCRIPTION OF THE INVENTION

The present invention may be understood more readily by reference to the following detailed description of the various embodiments of the invention and the Figures. The present invention is more particularly described in the following examples that are intended to be illustrative only since numerous modifications and variations therein will be apparent to those skilled in the art. As used in the specification and in the claims, the singular form "a," "an" and "the" include plural referents unless the context clearly dictates otherwise.

Ranges may be expressed herein as from "about" or "approximately" one particular value and/or to "about" or "approximately" another particular value. When such a range is expressed, another embodiment comprises from the one particular value and/or to the other particular value. Similarly, when values are expressed as approximations, by use of the antecedent "about," it will be understood that the particular value forms another embodiment.

The present invention is directed to a vacuum device 10 and system for providing a vacuum source. In various embodiments, the present invention may be applied in situation where substances need to be extracted and/or monitored for its characteristics. For example, the present invention may be used to provide a vacuum to extract fluid from a biological tissue and to measure the contents of the fluids for certain characteristic analytes including, without limitation, acetic acid, pH, glucose, lactic acid, C02, and various vitamins and nutrients. Furthermore, the fluid can be any type of biological fluid including, without limitation, blood, interstitial fluid, urea, sweat, plasma and lymph.

As depicted in FIGS. 1–5, the vacuum device 10 of the present invention preferably comprises an upper member 20, a lower member 40, a vacuum pump 60, an energy source 80, and an elastic membrane 100. The upper member 20 has a bottom surface 22 defining a bottom opening 24. The lower member 40, which is selectively coupled to the upper member 20, has a first surface 42 and an opposed second surface 46. When the lower member 40 is coupled to the upper member 20 at least a portion of the first surface 42 of the lower member 40 adjoins a portion of the bottom surface 22 of the upper member 20. The lower member 40 defines a first opening 44 in the first surface 42, a second opening 48 in the second surface 46, and an inner cavity 50 having an inner surface 52. As one will appreciate, the first opening 44 and the second opening 48 are in fluid communication with the inner cavity 50 of the lower member 40.

The elastic membrane 100 is disposed therein the inner cavity 50 of the lower member 40 and is coupled to the first opening 44 of the lower member 40. The elastic membrane 100 has an interior surface 102 and an exterior surface 104. When disposed in the inner cavity 50 of the lower member 40, the elastic membrane 100 generally forms a pouch 106 which defines an interior cavity 108 that is in communication with the first opening 44 of the lower member 40. As one will appreciate, by storing gas 120, for example, oxygen, in the pouch 106 formed by the elastic membrane 100, the pouch 106 may be expanded so that at least a portion of the exterior surface 104 of the membrane 100 is placed into contact with a portion of the inner surface 52 of the inner cavity 50 of the lower member 40. It is preferred that, when the pouch 106 is expanded, at least the portion of the exterior surface 104 of the elastic membrane 100 proximate the second opening 48 be in contact with portions of the inner surface 52 proximate the second opening 48 of the lower member 40. The gas 120 may be any suitable non-toxic gas capable of being stored in the pouch 106. The elastic membrane 100 is preferably made of polyurethrane or other non-rigid material capable of containing the gas 120 until the gas 120 is released from the pouch 106.

The vacuum pump 60 is disposed therein the upper body and is in selective electrical contact with the energy source 80. The vacuum pump 60 is in fluid communication with the bottom opening 24 of the upper member 20. An example of one suitable vacuum pump 60 is exemplified by an electrochemical pump made by Med-e-Cell and which are subject to U.S. Pat. No. 4,648,955, U.S. Pat. No. 5,149,413, U.S. Pat. No. 5,334,304, and U.S. Pat. No. 5,417,822, which are incorporated by reference to the extent that they are not inconsistent.

The energy source 80 activates the vacuum pump 60 for withdrawing gas 120 from the interior cavity 108 of the membrane. As shown in the figures, in one preferred example, the energy source 80 is disposed in the lower member 40. Any energy source 80 may be suitable. These include, without limitation, a battery, direct current, and a photoreceptor cell. According to certain embodiments, the energy source 80 is a battery capable of producing 1.5V to 3V and may produce a current of approximately 5 milliamps.

Thus, in use, the upper member 20 and lower member 40 are coupled together in overlying registration and aligned such that the energy source 80 is electrically coupled to the vacuum pump 60 and the bottom opening 24 of the upper member 20 mates to the first opening 44 of the first surface 42 of the lower member 40 so that a seal exists between the bottom opening 24 and the first opening 44. As one will appreciate, when the bottom opening 24 and the first opening 44 are in sealed contact with each other, the vacuum pump 60 is in fluid communication with the interior cavity 108 of the elastic membrane 100.

Referring particularly to FIG. 3, the vacuum device 10 may also comprise a rupturable membrane 130 disposed on the first surface 42 of the lower member 40 in overlying registration with the first opening 44 of the lower member 40. In an unruptured state, the rupturable membrane 130 seals the gas 120 therein the interior cavity 108 of the elastic membrane 100 (i.e., within the formed "pouch" 106). To open the rupturable membrane 130 and to affect a more secure seal between the first opening 44 and the bottom opening 24, the bottom surface 22 of the upper member 20 may have a male port 26 that depends from the bottom surface 22. The apex of the male port 26 preferably defines the bottom opening 24 of the upper member 20.

Referring back generally to FIGS. 1–5, as one will appreciate, when the upper member 20 is placed into overlying registration with the lower member 40, the male port 26 penetrates and passes through the rupturable membrane 130 and into a portion of the first opening 44 to place the vacuum pump 60 into fluid communication with the gas 120 contained therein the pouch 106 formed by the elastic membrane 100.

To further enhance the seal between the bottom opening 24 and the first opening 44, a pliable gasket 136 may be disposed on a portion of the bottom surface 22 of the upper member 20 proximate the male port 26. It is preferred that the pliable gasket 136 extend circumferentially about the base of the male port 26. As one will appreciate, the pliable gasket 136 is interposed between a portion of the bottom surface 22 and a portion of the first surface 42 when the upper member 20 and lower member 40 are coupled together, which aids in preventing gas 120 from leaking from the interior cavity 108.

As shown in FIGS. 4 and 5, the elastic membrane 100 is movable from a first relaxed position, in which the exterior surface 104 of the elastic membrane 100 is in contact with the inner surface 52 of the inner cavity 50 of the lower member 40 proximate the second opening 48 of the lower member 40, to a second operative position, in which portions of the elastic membrane 100 proximate the second opening 48 are drawn away from the inner surface 52 of the inner cavity 50 and toward the first opening 44 of the lower member 40 so that a fluid cavity 56, in communication with the second opening 48 of the lower member 40, is defined by the exterior surface 104 of the portions of the elastic membrane 100 proximate to and spaced from the second opening 48 and the portions of the "exposed" inner surface 52 of the inner cavity 50 of the lower member 40 that extend from the second opening 48 to where the exterior surface 104 of the elastic membrane 100 contacts the inner surface 52 of the inner cavity 50 of the lower member 40. The elastic membrane 100 moves from the first relaxed position to the second operative position in response to the application of vacuum to the interior cavity 108 as a result of the actuation of the vacuum pump 60.

As one will further appreciate, as the pouch 106 decreases in size, the fluid cavity 56 expands therein the inner cavity 50 of the lower member 40. As a result, the expanding fluid cavity 56 creates a vacuum source from which a substance, such as fluid or a gas, can be drawn in through the second opening 48 of the lower member 40. Depending on the embodiment, the present invention either directly draw fluid directly from a surface 2 acting as a fluid source, such as, for example, a biological membrane, to which the second surface 46 of the lower member 40 may be attached. Alternatively, the vacuum device 10 invention could indirectly draw fluid via a fluid conduit 4 that connects the second opening 48 of the lower member 40 of the vacuum device 10 to the fluid source of the fluid from which it is drawing.

As the vacuum device 10 draws in the substance into the fluid cavity 56 created by the shrinking pouch 106, the fluid cavity 56 may be used for storing the substance within the inner cavity 50 of the lower member 40. In this embodiment, the vacuum device 10 includes a one-way stop valve [not shown] disposed in the second opening 48 of the lower member 40. The stop valve is oriented inwardly toward the inner cavity 50 of the lower member 40 to allow for one-way passage of substances into the fluid cavity 56.

According to several embodiments of the present invention, the upper and lower members 20, 40 of the vacuum device 10 may be separate components that are coupled together in proper overlying registration when it is desired to activate the vacuum device 10. However, it is contemplated that the upper and lower members 20, 40 of the vacuum device 10 may be integrated into one cohesive unit with the proper alignment of electrical connections and respective openings already achieved and maintained. In this example, the vacuum device 10 does not activate as a result of the coupling of the upper and lower members 20, 40. Depending on the application of the present invention, both types of embodiments may perform the same function and produce the same result. Nevertheless, applications where a disposable component is desired may be better served by embodiments where the upper member 20 and lower member 40 exist as separate components that activate the vacuum device 10 upon the proper overlying registration of the upper and lower members 20, 40.

To aid in the proper overlying registration of the upper and lower members 20, 40 (i.e., to insure that the respective electrical contacts and openings in proper alignment and connection), the upper and lower members 20, 40 of the vacuum device 10 may have complementary engaging elements. In one example, the upper member 20 may have a male engaging element 150 that depends from a circumferential edge of the upper member 20 and the lower member 40 may have a circumferentially extending female engaging element 152. Aa one will appreciate, the male engaging element 150 and the female engaging element 152 are complementarily sized so that, when the upper and lower members 20, 40 are selectively coupled together, a complementary interference fit is formed.

When the male and female engaging elements 150, 152 are connected, and the respective electrical connections are coupled and respective complementary openings are properly aligned, the vacuum device 10 can become activated. As noted above, it is contemplated, in certain embodiments, that the upper and lower members 20, 40 have complementary upper and lower electrical contacts 90, 92 which may or may not be in addition to the complementary engaging elements 150, 152. In such embodiments, the upper electrical contact 90 is also further electrically coupled to the vacuum pump 60 and the lower electrical contact 92 is electrically coupled to the energy source 80. When the electrical contacts 90, 92 are properly aligned upon the proper overlying registration of the upper and lower member 40*s*, the energy source 80 becomes activated so that the vacuum pump 60 is activated. When the upper member 20 and lower member 40 are not properly aligned or are disengaged (i.e., they are not in operative contact with each other), the electrical contacts 90, 92 are not in contact so that the energy source 80 cannot activate the vacuum pump 60 which consequently leaves the vacuum device 10 in an inoperable state.

The present invention has many useful applications where a vacuum source for fluids is desired. For example, the present invention may be used in a system where biological fluids are being monitored either on a discrete or continual basis. In such applications, embodiments of the vacuum device 10 may further comprise an assay sensor 160. The embodiments may further comprise a pressure pump 170, a fluid reservoir 180, and a fluid conduit 190.

In one example, the pressure pump 170 is disposed therein the upper member 20 and is in fluid communication with a pressure opening 172 defined in the bottom surface 22 of the upper member 20. The pressure opening 172 is preferably spaced from the bottom opening 24 of the upper member 20. The pressure pump 170 is selectively coupled to the energy source 80.

The fluid reservoir 180 is disposed therein the lower member 40 and is in fluid communication with a third opening 182 defined in the first surface 42 of the lower member 40. A calibration fluid 184 is disposed therein the fluid reservoir 180. The third opening 182 is preferably spaced from the first opening 44 of the lower member 40. The fluid conduit 190 has a proximal end 192 and an opposing distal end 194. The proximal end 192 of the fluid conduit 190 is coupled to the fluid reservoir 180 and the distal end 194 is coupled to a port 196 defined in the inner surface 52 of the inner cavity 50 of the lower member 40. The port 196 is preferably proximate the second opening 48 of the lower member 40 and is in fluid communication with the inner cavity 50 of the lower member 40.

The assay sensor 160 is preferably disposed on the inner surface 52 of the inner cavity 50 of the lower member 40 proximate the second opening 48 of the lower member 40. It is preferred that the assay sensor 160 be disposed on the inner surface 52 in close proximity to the port 196 defined in the inner surface 52 of the inner cavity 50 of the lower member 40. The assay sensor 160 is capable of sensing a characteristic of the fluid. The characteristic may include, but are not limited to, for example, pH, glucose, lactic acid, carbon dioxide, vitamin, and mineral.

In use, when the upper and lower members 20, 40 are coupled together in proper overlying registration, the bottom opening 24 of the upper member 20 is in sealed contact with the first opening 44 of the lower member 40, the pressure opening 172 of the upper member 20 is in sealed contact with the third opening 182 of the lower member 40, and the pressure pump 170 is electrically coupled to the energy source 80 for actuation of the pressure pump 170. In this configuration, the pressure pump 170 is in fluid communication with the calibration fluid 184 within the fluid reservoir 180. The pressure pump 170 is moveable from a first de-energized position, in which the pressure pump 170 is deactivated and pressure is not communicated to the calibration fluid 184 in the fluid reservoir 180 of the lower member 40, to a second energized position, in which pressure is communicated to the calibration fluid 184 in the fluid reservoir 180 of the lower member 40 from the pressure pump 170 upon actuation of the pressure pump 170.

Once the upper and lower members 20, 40 are coupled in proper overlying registration, the pressure pump 170 is in fluid communication, via the port 196, with the assay sensor 160. As noted above, the assay sensor 160 may be configured to measure characteristics of the fluid. In certain embodiments, the assay sensor 160 acts in conjunction with the calibration fluid 184 flowing out of the port 196 from the fluid reservoir 180 for appropriate measurements of the desired characteristics.

The upper member 20 further comprises a system controller 200 that further comprises of a processor 202, a transmitter 204, and a circuit card assembly 206(CCA) that can control various aspects of the operation of the system once activated. The system controller 200 is preferably disposed therein the upper member 20 and is electrically coupled to the assay sensor 160 and the energy source 80. As one will appreciate, the system controller 200 may also be preferably electrically coupled to the vacuum pump 60 and the pressure pump 170. In this example, the system controller 200 can control the flow rate of the vacuum pump 60. In one embodiment, the system controller 200 controls the vacuum pump 60 such that the flow rate is approximately 9 inches of vacuum to flow 8 microliters per hour through the second opening 48 of the lower member 40. The system controller 200 can then process the characteristic of the fluid being drawn into the fluid cavity 56 via the second opening 48. As the fluid is passed into the fluid cavity 56, it passes across the assay sensor 160.

As one will appreciate, while the fluid is being analyzed and measured, the system controller 200 can also activate the pressure pump 170 when needed such that the pressure pump 60 induces a positive pressure into the fluid reservoir 180 so that calibration fluid 184 is exuded from the port 196 across the assay sensor 160 to assist the assay sensor 160 in sensing the desired characteristics. In certain embodiments, the fluid drawn into the vacuum device 10 is interstitial fluid and the characteristic is glucose. However, as mentioned above, the present invention may applied to monitor any fluid for any characteristics capable of being measured. Moreover, as the assay sensor 160 measures the characteristic, the system controller 200 can further transmit the results to a display 210 located on the vacuum device 10 or alternatively, to a remote display.

Thus, according to these embodiments, the vacuum device 10 can become operational when: (1) the upper member 20 and the lower member 40 are coupled in proper overlying registration so that a seal is created between the respective complementary opening of the upper and lower members 20, 40; (2) the corresponding complementary openings within the respective upper and lower members 20, 40 are properly aligned; and (3) the complementary electrical contacts 90, 92 of the upper and lower members 20, 40 become properly aligned such that the alignment triggers the system controller 200 to activate the energy source 80 which in turn will activate the vacuum pump 60, the pressure pump 170, the assay sensor 160 and the transmitter 204. If the embodiment is where the display 210 is also on the vacuum device 10, then the system controller 200 will activate the display reading as well via the energy source 80.

As the upper and lower members 20, 40 are brought into close proximity to one another, the male port 26 of the upper member 20 contacts the rupturable membrane 130 and eventually ruptures it as the proper registration and coupling is achieved. When the vacuum device 10 is properly coupled, the energy source 80 activates the pressure pump 170 and the vacuum pump 60. The vacuum pump 60 pulls the gas 120, for example, oxygen, from the pouch 106 which it now is in fluid communication as a result of the penetration of the rupturable membrane 130. As the vacuum pump 60 pulls the gas 120 from within the pouch 106, a vacuum source is created within the inner cavity 50 of the lower member 40 as a result of the gas 120 exiting the pouch 106 and the consequent decreasing size of the pouch 106 which no longer fills the inner cavity 50. As a result the negative pressure created by the vacuum source allows for fluid to be drawn in through the second opening 48 of the lower member 40 into the formed fluid cavity 56.

The invention has been described herein in considerable detail, in order to comply with the Patent Statutes and to provide those skilled in the art with information needed to apply the novel principles, and to construct and use such specialized components as are required. However, it is to be understood that the invention can be carried out by specifically different equipment and devices, and that various modification, both as to equipment details and operating procedures can be affected without departing from the scope of the invention itself. Further, it should be understood that, although the present invention has been described with reference to specific details of certain embodiments thereof, it is not intended that such details should be regarded as limitations upon the scope of the invention except as and to the extent that they are included in the accompanying claims.

We claim:

1. A vacuum device for extraction of a substance, comprising:

an upper member having a bottom surface, the bottom surface defining a bottom opening;

a vacuum pump therein the upper member, the vacuum pump in fluid communication with the bottom opening;

an energy source selectively coupled to the vacuum pump;

a lower member selectively coupled to the upper member, the lower member having a first surface, an opposing second surface, and defining an inner cavity having an inner surface, wherein the first surface defines a first opening and the second surface defines a second opening, the second opening of the lower member in selective fluid communication with the fluid source, and wherein the inner cavity is in fluid communication with the first opening and the second opening; and an elastic membrane disposed therein the inner cavity and coupled to the first opening of the lower member, the membrane having an interior surface and an exterior surface, the membrane forming a generally pouch shape defining an interior cavity that is in communication with the first opening of the lower member, wherein at least a portion of the exterior surface of the membrane is in contact with a portion of the inner surface of the inner cavity of the lower member, and wherein, in use, the lower member is selectively coupled to the upper member such that the energy source is electrically coupled to the vacuum pump and the bottom opening of the upper member is in sealed contact with the first opening of the lower member so that the vacuum pump is in fluid communication with the interior cavity of the elastic membrane.

2. The vacuum device of claim 1, wherein the upper member has a male engaging element depending from a circumferential edge of the upper member, and wherein the lower member has a circumferentially extending female engaging element, the male engaging element and the female engaging element complementarily sized for a complementary interference fit when the upper and lower members are selectively connected together.

3. The vacuum device of claim 1, wherein the second surface of the lower member is mountable on a biological membrane so that the second opening of the lower member is positioned proximate the biological membrane for withdrawl of the substance from the biological membrane.

4. The vacuum device of claim 1, wherein the energy source is disposed therein the lower member.

5. The vacuum device of claim 1, wherein the membrane is movable from a first relaxed position, in which the exterior surface of the membrane is in contact with the inner surface of the inner cavity of the lower member proximate the second opening of the lower member, to a second operative position, in which portions of the membrane proximate the second opening are drawn away from the inner surface of the inner cavity and toward the first opening of the lower member so that a fluid cavity, in communication with the second opening of the lower member, is defined by the exterior surface of the portions of the membrane proximate the second opening and the portions of the inner surface of the inner cavity of the lower member extending from the second opening to the contact of the exterior surface of the membrane with the inner surface of the inner cavity, wherein the membrane moves from the first relaxed position to the second operative position upon application of vacuum to the interior cavity due to the actuation of the vacuum pump so that vacuum is applied to the second opening of the lower member.

6. The vacuum device of claim 1, further comprising a rupturable membrane disposed thereon the first surface of the lower member in overlying registration with the first opening of the lower member.

7. The vacuum device of claim 6, further comprising a gas sealed therein the interior cavity of the membrane by the rupturable membrane.

8. The vacuum device of claim 7, wherein the bottom surface of the upper member has a male port depending from the bottom surface, the male port defining the bottom opening of the upper member, wherein the first opening of the lower member has a female shape complementary to the male port of the upper member.

9. The vacuum device of claim 8, further comprising a pliable gasket in contact with a portion of the bottom surface of the upper member proximate the male port.

10. The vacuum device of claim 1, wherein the bottom surface of the upper member defines a pressure opening, wherein the first surface of the lower member defines a third opening, and wherein the inner surface of the lower member defines a port, proximate the second opening of the lower member, in communication with the inner cavity of the lower member, further comprising:

a pressure pump disposed therein the upper member, the pressure pump selectively coupled to the energy source and in fluid communication with the pressure opening of the upper member;

a fluid reservoir disposed therein the lower member, the fluid reservoir in fluid communication with the third opening in the lower member;

a calibration fluid disposed therein the fluid reservoir; and a fluid conduit having a proximal end and a distal end, the proximal end coupled to the fluid reservoir, the distal end coupled to the port of the lower member, wherein, in use, the lower member is selectively coupled to the upper member such that the pressure pump is electrically coupled to the energy source and the pressure opening of the upper member is in sealed contact with the third opening of the lower member so that the pressure pump is in fluid communication with the port of the lower member.

11. The vacuum device of claim 10, wherein the pressure pump is moveable from a first de-energized position, in which the pressure pump is deactivated and pressure is not communicated to the fluid in the fluid reservoir of the lower member, to a second energized position, in which pressure is communicated to the fluid in the fluid reservoir of the lower member from the pressure pump upon actuation of the pressure pump.

12. The vacuum device of claim 10, further comprising:

an assay sensor disposed on the inner surface of the inner cavity of the lower member proximate the second opening in the lower member; and a system controller electrically coupled to the assay sensor and the energy source.

13. The vacuum device of claim 12, wherein the system controller is electrically coupled to the vacuum source and the pressure pump.

14. The vacuum device of claim 12, wherein the assay sensor extends circumferentially about the second opening in the lower member.

15. The vacuum device of claim 12, wherein the assay sensor is disposed on the inner surface proximate the port.

16. The vacuum device of claim 12, wherein the assay sensor can sense a characteristic of the fluid selected from a group consisting of pH, glucose, lactic acid, carbon dioxide, vitamin, and mineral.

17. The vacuum device of claim 12, wherein the system controller comprises:

a circuit card assembly disposed therein the upper member;

a processor electrically coupled to the circuit card assembly; and a transmitter electrically coupled to the circuit card assembly.

18. The vacuum device of claim 12, further comprising:

at least one upper electrical contact disposed on the bottom surface of the upper member, the upper electrical contact electrically coupled to the system controller; and at least one lower electrical contact disposed on the first surface of the lower member, the lower electrical contact electrically coupled to the assay sensor, wherein, in use, the lower member is selectively coupled to the upper member such that the upper electrical contact is in contact with the lower electrical contact to complete the electrical coupling of the system controller and the assay sensor.

19. The vacuum device of claim 18, wherein the lower electrical contact is electrically coupled to the energy source.

20. The vacuum device of claim 5, further comprising a one-way stop valve disposed in the second opening of the lower member; the stop valve oriented inwardly toward the inner cavity of the lower member to allow one-way passage of substance into the fluid cavity.

* * * * *